US005111746A

United States Patent [19]

Pentel et al.

[11] Patent Number: 5,111,746

[45] Date of Patent: May 12, 1992

[54] MULTIPLE STAGE MUNITION

[75] Inventors: Jerry Pentel, Montville; Gary G. Fairbanks, Newtown, both of N.J.

[73] Assignee: The United States of America as represented by the Secretary of the Army, Washington, D.C.

[21] Appl. No.: 718,700

[22] Filed: Jun. 21, 1991

[51] Int. Cl.[5] ..... F42B 1/02; F42B 12/18

[52] U.S. Cl. ..... 102/308; 102/310; 102/476

[58] Field of Search ..... 102/476, 306, 310, 308

[56] References Cited

U.S. PATENT DOCUMENTS

| | | | |
|---|---|---|---|
| H 867 | 1/1991 | Hill | 102/476 |
| 3,233,415 | 2/1966 | Thomas | 102/306 |
| 4,063,512 | 12/1977 | Davis | 102/476 |
| 4,606,272 | 8/1986 | Kerdraon | 102/310 |
| 4,803,928 | 2/1989 | Kramer et al. | 102/306 |
| 4,823,700 | 4/1989 | Alker et al. | 102/476 |
| 4,989,517 | 2/1991 | Adimari et al. | 102/476 |
| 5,003,883 | 4/1991 | Mixon et al. | 102/476 |

*Primary Examiner*—David H. Brown

*Attorney, Agent, or Firm*—Anthony T. Lane; Edward Goldberg; Michael C. Sachs

[57] ABSTRACT

A munition and method for making a borehole in a target and for placement of an explosive unit in the borehole. The munition includes an outer body having a chamber, an inner body disposed in the chamber and having a cavity, a piston disposed in the cavity forming a rear space, the outer body having a front shaped charge wall, the chamber having a first explosive and detonator, a penetrator partly disposed in the cavity and extending through a front wall of the inner body, and a second detonator and explosive disposed in a penetrator compartment.

10 Claims, 2 Drawing Sheets

MULTIPLE STAGE MUNITION

GOVERNMENTAL INTEREST

The invention described herein may be manufactured, used, and licensed by or for the Government for governmental purposes without the payment to us of any royalty thereon.

FIELD OF THE INVENTION

The invention relates to a multiple stage munition and method, and in particular the invention relates to a multiple stage munition having an outer body with an outer detonator and outer explosive and having a flyable inner body with an inner detonator and inner explosive.

BACKGROUND OF THE INVENTION

The prior art munition which is a single stage munition includes an outer body having a peripheral plate and a first end shaped charge and a second end detonator plate enclosing a chamber containing an explosive and a wave forming body.

One problem with the prior art munition is that it is difficult to place a detonation charge in a hole in a target caused by the first end shaped charge.

SUMMARY OF THE INVENTION

According to the present invention, a multiple stage munition is provided. This munition comprises an outer body having a peripheral plate and a first end shaped charge or explosively formed generator and a second end detonator plate enclosing a chamber containing an outer explosive and a wave forming body, and comprises an inner body having a peripheral wall and a first end wall supporting the wave forming body and a second end open wall together enclosing a cavity, and comprises a penetrator unit disposed in the cavity and having a thrust transmitting wall forming a space at one end of the cavity next to the second end open wall for containing some of the outer explosive and having an annular wall with a compartment containing an inner explosive and having a rear wall with a delay detonator disposed between the compartment and the space.

The foregoing and other objects, features and advantages will be apparent from the following description of the preferred embodiment of the invention as illustrated in the accompanying drawings.

DESCRIPTION OF THE PREFERRED EMBODIMENTS

Figure 1:
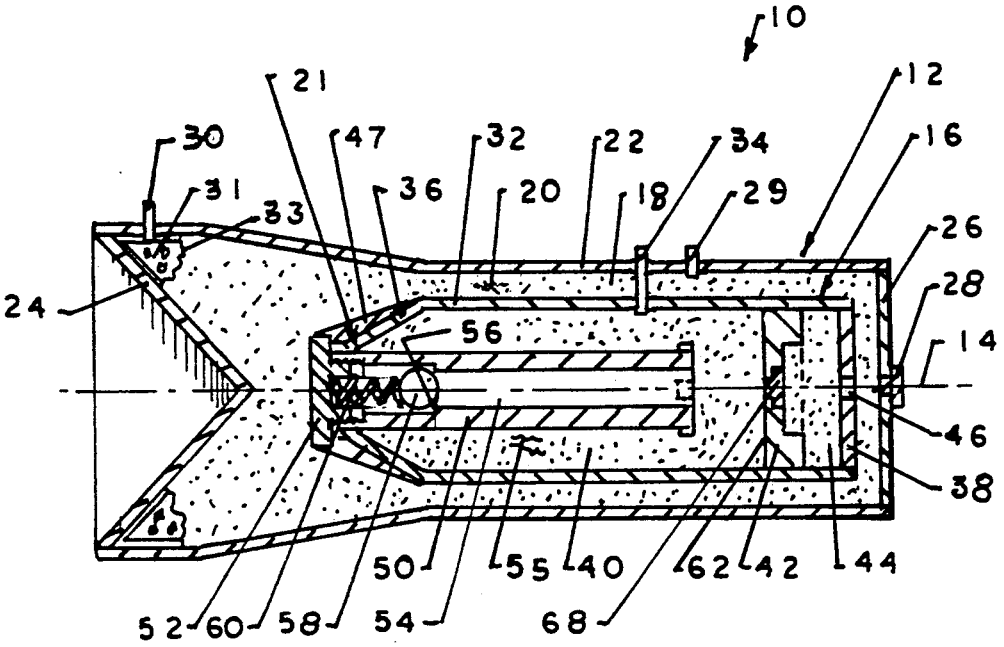
FIG. 1 is a sectional view of a munition according to the present invention before firing.

As shown in FIG. 1, a munition or munition assembly or first embodiment 10 is provided. Munition 10 includes an outer body or casing 12 which has an axis 14, and includes an inner body or unit 16 which is disposed inside the casing 12 forming therebetween an outer chamber 18 that contains an outer explosive 20, and includes an injector unit 21 partly disposed inside inner unit 16.

Outer casing 12 has a peripheral plate 22 of cylindrical shape, a left shaped charge of conical shape or explosively shaped charge 24, and a right end flat plate 26. Right plate 26 has an outer detonator 28 disposed on axis 14. Peripheral plate 22 has a right filler tube 29 for filling chamber 18 with explosive 20. Peripheral plate 22 has a left filler valve or tube 30 for filling an inflatable annular diaphragm 33 with air or a material 31, which is disposed at a left end portion of chamber 18. Diaphragm 33 is inflated to control the diameter of contact of explosive 20 on shaped charge 24 thereby adjusting the effective diameter of shaped charge 24.

Inner unit 16 has an inner peripheral wall 32 of cylindrical shape which has a filler tube 34, a left inner end wall 36, and a right inner end wall 38. Walls 32, 36, 8 enclose a cavity 40, which contains a thrust transmitting member or piston 42. Piston 42 is disposed at the right end of cavity 40 forming a space 44. Space 44 contains some of the explosive 20 and is disposed between piston 42 and right wall 38. Right wall 38 has an axial opening 46 which is disposed between space 44 and part of chamber 18. Left inner wall 36 has an annular wave shaper member 47 mounted on the exterior thereof. Left inner wall 36 has an axial opening 48, which receives and supports injector 21.

Injector 21 has an annular plunger wall 50, which has a left wall or threaded cap 52 and which has an elongate passage 54. Passage 54, which has an open end, receives some of an extrudable paste or liquid explosive 55 that is filled in cavity 40 when detonator 28 is initiated and piston 42 moves to the left. Passage 54 has a valve seat 56 and a valve ball 58 and a valve spring 60.

Figure 2:
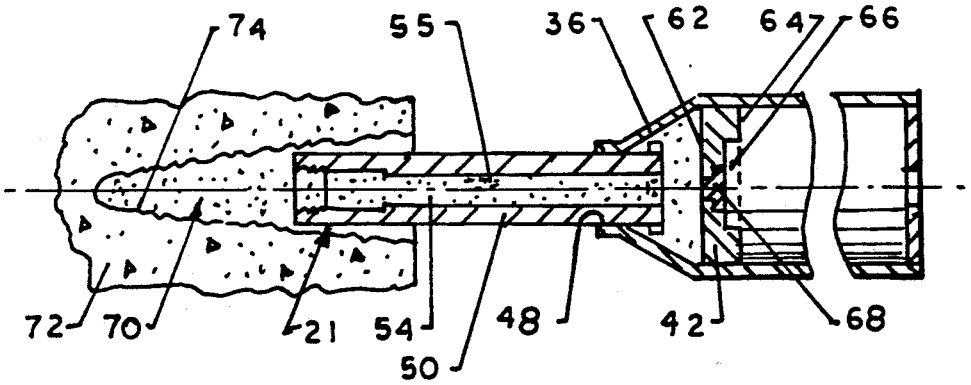
FIG. 2 is an enlarged view of a portion of FIG. 1 after firing.

As shown in FIG. 2, when piston 42 is pushed to the left, valve ball 58 is opened to the left. Pressure from extrudable paste or liquid explosive 55 in passage 54 shears away cap 52, so that extrudable paste explosive 55 is pushed into a borehole 70 in a target 72 from passage 54. Borehole 70 is formed by an impact force on target 72 from jets created by shaped charge 24, which is a conventional shaped charge. Piston 42 has a left face 62 which pushes explosive 55 from cavity 40 into passage 54. Piston 42 also has a right face 64, which has a recess 66. Piston 42 also has a coaxial delay detonator 68 between left face 62 and right face 64.

In operation, detonator 28 is initiated. Explosive 20 is then activated. A shock wave travels alongside inner body 16. Then, shaped charge 24 collapses forming a jet which forms a borehole 70 in target 72. Inner unit 16 is also propelled at a slower speed than the speed of the jet of shaped charge 24. Extended injector 21, as shown in FIG. 2, is embedded into borehole 70. Piston 42 pushes on paste or liquid explosive 55 and injector 21 is extended due to pressure on right face 64 caused by explosive 20, or the like, in space 44, during flight to target 72. Paste or liquid explosive 55 moves into a bottom part 74 of borehole 70 upon impact and embedment. Delay detonator 68 is then initiated. Paste explosive 55 in hole 70 is then activated, for blasting target 72. Bearing ball 58, spring 60, and cap 52 are pushed out from injector 21 after injector 21 is extended during the flight.

Figure 3:
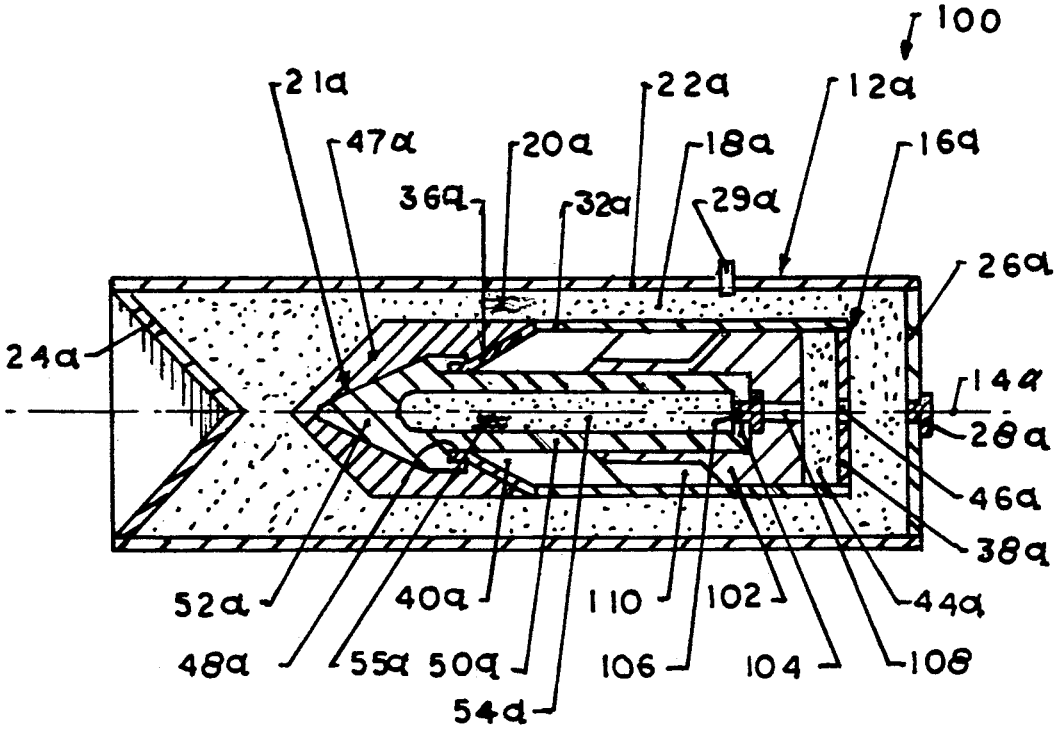
FIG. 3 is a sectional view of a second embodiment of a munition according to the present invention before firing.

As shown in FIG. 3, second embodiment or munition 100 is provided. Parts of second embodiment 100, which have the same parts as first embodiment 10, have the same numerals but with a subscript "a" added thereto.

Munition 100 includes outer body 12a with an axis 14a, and includes an inner body 16a forming therebetween a chamber 18a containing an explosive 20a, and includes a penetrator 21a.

Outer body 12a has a peripheral plate 22a, a left shaped charge core 24a and a right plate 26a. Right plate 26a has a detonator 28a. Peripheral plate 22a has a right filler tube 29a.

Inner body 16a has a peripheral wall 32a, and a left wall 36a, and a right wall 38a. Walls 32a, 36a, 38a enclose a cavity 40a. Cavity 40a contains a thrust transmitting sabot or piston-like member 102. Sabot 102 forms a space 44a in cavity 40a. Right wall 38a has an axial opening 46a. Left wall 36a has an annular wave shaper member 47a. Left wall 36a also has an axial opening 48a which receives penetrator 21a.

Penetrator 21a has a annular wall 50a, and a pointed left wall 52a forming an elongate compartment 54a. Compartment 54a contains an explosive 55a. Penetrator 21a also has a rear wall 104 with a delay detonator 106. Sabot 102 has an opening 108 disposed between delay detonator 106 and space 44a. Sabot 102 also has a plurality of ribs 110.

In operation, detonator 28a is initiated. Explosive 20a is then activated. Then, shaped charge 24a is propelled as a jet to a target (not shown) forming a borehole (not shown). Inner body 16a is also propelled at a slower speed than the speed of the jet of shaped charge 24a. Penetrator 21a is embedded into the borehole. During flight, penetrator 21a is extended by pressure on sabot 102; and wave shaper 47a breaks away. After embedment of penetrator 21a in the borehole, delay detonator 106 is initiated, so that explosive 55a is activated, for blasting the target.

The materials are indicated hereafter. The walls of outer body 12, 12a and inner body 16, 16a are metal or plastic material, and injector 21 and penetrator 21a are a metal material. Explosive 55 is a high explosive paste; and, as an alternate, a high explosive liquid can be used. Explosive 20a is a high explosive paste; and as an alternate, a high explosive liquid can be used. Explosive 55a is a high explosive charge. Axial opening 46, 46a can have a selective detonator as an alternate added feature. Recess 66 can also have a selective explosive material as an alternate added feature.

Advantages of munition 10, 100 are indicated hereafter.

A) Munition 10, 100 places a detonation charge 55 in a hole 70 of a target 72 which was previously caused by a shaped charge 24.

B) Valve ball 58 protects explosive 55 inside penetrator 21 from a premature initiation caused by a fragment of shaped charge 24.

C) Extended injector 21 can dispense a paste explosive or a liquid explosive at the bottom 74 of a borehole 70 made in a target 72 by the shaped charge 24.

D) Explosive 55 can be loaded into cavity 40 through tube 34, and explosive 20 can be loaded into chamber 18 through tube 29, just prior to a deployment on a site, for greater safety.

While the invention has been described in its preferred embodiment, it is to be understood that the words which have been used are words of description rather than limitation and that changes may be made within the purview of the appended claims without departing from the true scope and spirit of the invention in its broader aspects.

For example, piston 42 can be a dual piston unit, in order to increase the tamping of the explosive 55 in hole 70 of target 72. The second piston or added piston portion would be to the left of and in contact with and coaxial with piston 42. The second added piston has a right face with a recess containing a propelling charge. When injector 21 is embedded in hole 70, just prior to the actuation of charge 55, the second added piston will be actuated by its propelling charge to tamp the explosive 55 in hole 70, then, explosive 55 will be actuated.

As another example, the part of explosive 20 between peripheral plate 22 and peripheral wall 32 over a selected axial length can be removed, and a spiral tubing or coil can be substituted therefor, in order to provide a slower travel of a detonation wave to the left shaped charge cone 24. The coil helps to balance the inner and outer pressures on wall 32.

As a further example, plunger 50 can be made using two telescoping tubes, instead of one tube, in order to increase the length of the extension of plunger 50.

The embodiments of an invention in which an exclusive property or right is claimed are defined as follows:

1. A munition comprising:

an outer body which has an axis and a front shaped charge;

an inner body which is disposed coaxially inside the outer body and which forms therebetween a chamber;

a first explosive which is disposed in the chamber;

a penetrator unit which is partly disposed coaxially inside the inner body and which forms therebetween a cavity; and a second explosive for exploding in the penetrator unit.

2. The munition of claim 1, including:

a piston member disposed in the cavity forming a space containing a third explosive for urging the penetrator unit from a retracted position to an extended position.

3. The munition of claim 2, wherein the penetrator unit has an annular wall and a first end pressure valve wall and a second end open wall enclosing an elongate passage for extrusion therethrough of the second explosive by pressure from the piston member.

4. The munition of claim 2, wherein the penetrator unit has an annular wall and a front end pointed closed wall and a second end rear wall enclosing an elongate compartment containing the second explosive.

5. The munition of claim 2, wherein the outer body has a peripheral plate joined to the front shaped charge and to a back end detonator plate.

6. The munition of claim 5, including an annular diaphragm member disposed between an inner surface of the shaped charge and an inner surface of the outer peripheral plate forming an annular inflatable space, and including an air filler valve for expanding the space with air for thereby adjusting the contact diameter of the first explosive for adjusting the effective diameter of the shaped charge.

7. The munition of claim 5, wherein the inner body has a peripheral wall joined to a front end wave former wall and to a back end closure wall.

8. The munition of claim 7, wherein the peripheral plate has a filler tube opening into the chamber, and the peripheral wall has a second filler tube opening into the cavity.

9. The munition of claim 7, wherein the front end wave former wall has an annular wave former member mounted on the exterior thereof, and has an axial opening receiving the penetrator unit.

10. The munition of claim 7, wherein the back end detonator plate has a first detonator, and wherein the back end closure wall has an opening, and wherein the piston member has a second detonator.

* * * * *